US008502628B2

(12) United States Patent
Graf et al.

(10) Patent No.: US 8,502,628 B2
(45) Date of Patent: Aug. 6, 2013

(54) MAGNETIC CHAMBER FOR ELECTROMAGNETIC LOW VOLTAGE SWITCHGEAR, AND ELECTROMAGNETIC LOW VOLTAGE SWITCHGEAR

(75) Inventors: Josef Graf, Hahnbach (DE); Mathias Völz, Oldenburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/935,338

(22) PCT Filed: Mar. 11, 2009

(86) PCT No.: PCT/EP2009/052828

§ 371 (c)(1),
(2), (4) Date: Sep. 29, 2010

(87) PCT Pub. No.: WO2009/121693

PCT Pub. Date: Oct. 8, 2009

(65) Prior Publication Data

US 2011/0043306 A1 Feb. 24, 2011

(30) Foreign Application Priority Data

Apr. 1, 2008 (EP) ..... 08400025

(51) Int. Cl.
*H01H 9/20* (2006.01)

(52) U.S. Cl.
USPC ..... 335/160; 335/132

(58) Field of Classification Search
USPC ..... 335/132, 159–163, 202
See application file for complete search history.

(56) References Cited

U.S. PATENT DOCUMENTS

| | | | | |
|---|---|---|---|---|
| 4,409,575 A | | 10/1983 | Hisadome | |
| 4,760,364 A | * | 7/1988 | Ostby | 335/132 |
| 5,289,146 A | * | 2/1994 | Plumeret et al. | 335/160 |
| 6,140,896 A | | 10/2000 | Heckenkamp | |

FOREIGN PATENT DOCUMENTS

| | | |
|---|---|---|
| CN | 1200837 | 12/1998 |
| CN | 1342323 | 3/2002 |
| DE | 691 10 195 | 9/1995 |
| EP | 0433550 A1 | 6/1991 |

OTHER PUBLICATIONS

Int'l. Search Report.
Chinese Office Action for Appln. No. CN 200980109696.9, dated Oct. 31, 2012.

* cited by examiner

*Primary Examiner* — Bernard Rojas
(74) *Attorney, Agent, or Firm* — Harness, Dickey & Pierce, P.L.C.

(57) ABSTRACT

A magnetic chamber is disclosed for electromagnetic low voltage switchgear, especially a compact reversing starter, including two magnetic drives which are each actuated by a main slide. The magnetic chamber is designed, in at least one embodiment, to receive both magnetic drives of the electromagnetic low voltage switchgear, and a mechanical reversing locking device held in a mobile manner for the alternating mechanical locking of the two magnetic drives is arranged in the magnetic chamber, the mechanical locking device acting on the two main slides. An electromagnetic low voltage switchgear is disclosed, especially a compact reversing starter, including two magnetic drives which are each actuated by a main slide, both magnetic drives being arranged in a magnetic chamber. The mechanical reversing locking device held in a mobile manner, in at least one embodiment, engages with the main slide of one of the magnetic drives, according to the position of the locking device, in order to fix said magnetic drive.

12 Claims, 3 Drawing Sheets

MAGNETIC CHAMBER FOR ELECTROMAGNETIC LOW VOLTAGE SWITCHGEAR, AND ELECTROMAGNETIC LOW VOLTAGE SWITCHGEAR

PRIORITY STATEMENT

This application is the national phase under 35 U.S.C. §371 of PCT International Application No. PCT/EP2009/052828 which has an International filing date of Mar. 11, 2009, which designates the United States of America, and which claims priority on European patent application number EP 08400025.6 filed Apr. 1, 2008, the entire contents of each of which are hereby incorporated herein by reference.

FIELD

At least one embodiment of the present invention generally relates to a magnetic chamber for an electromagnetic low voltage switchgear, in particular a compact reversing starter, generally comprising two magnetic drives which are each actuated by a main slide. At least one embodiment of the internal circuit is embodied such that a different motor operation direction is assigned to each magnetic drive. Furthermore, at least one embodiment of the invention generally relates to an electromagnetic low voltage switchgear, in particular a compact reversing starter, comprising two magnetic drives, which are each actuated by a main slide.

BACKGROUND

With current electromechanical low voltage switchgears, in particular of installation size S0/S00, a reversing locking device for the consumer branches is affected in an individual setup outside of the device. Two contactors are herewith wired up in parallel and a circuit breaker is to this end connected in series. The locking device is realized by additional parts, for instance an armature and a bearing, which are mounted between contactor drives and act on the contactmaker holder. With electrical reversing contactors, the locking device acts on the armature of the contactor drives for the mutual blocking. I.e. the reversing locking device for mutually blocking the main drives prevents simultaneous closure of the main contacts for changing the direction of rotation.

DE 691 10 195 T2 discloses an electrical reversing contactor, comprising a mechanical locking device for the moveable armature parts of the two contactor drives. The electrical reversing contactor comprises a housing, in which two cavities are provided, which each comprise a system of switching parts with its own electromechanical controller. I.e. the magnetic drive of the one system is arranged separately from the magnetic drive of the other system. A separate magnetic chamber is provided for each magnetic drive. A moveable locking part is provided between the two cavities, which prevents a simultaneous movement of the moveable contact holders which are coupled to the moveable armature parts, of the two magnetic drives.

The disadvantages with an electrical reversing contactor of this type are the complicated structure of the mechanical locking device and the indirect locking device of the magnetic drives. Furthermore, an electrical reversing contactor of this type is relatively large in terms of its exterior dimensions, since two separate magnetic chambers are provided in the housing of the electrical reversing contactor.

SUMMARY

At least one embodiment of the invention creates a magnetic chamber for an electromagnetic low voltage switchgear and/or an electromagnetic low voltage switchgear, which are structured in a simple and compact fashion and which enables a simple mechanical locking of one of two magnetic drives, while the other magnetic drive can be operated. In particular, a simple and direct mechanical locking of a main slide of a magnetic drive is enabled if the other magnetic drive is in operation.

At least one embodiment of the invention is directed to a magnetic chamber for an electromagnetic low voltage switchgear and/or an electromagnetic low voltage switchgear. Further features and details of the invention result from the subclaims, the description and the drawings. Features and details, which are described in conjunction with the magnetic chamber for an electromagnetic low voltage switchgear, naturally also apply here in conjunction with the electromagnetic low voltage switchgear and in each instance vice versa.

According to the first aspect of at least one embodiment of the invention, a magnetic chamber is disclosed for an electromagnetic low voltage switchgear, in particular a compact reversing starter, comprising two magnetic drives, with each magnetic drive actuating a main slide, in which the magnetic chamber is embodied to receive both magnetic drives of the electromagnetic low voltage switchgear, and with a moveably held mechanical reversing locking device being arranged in the magnetic chamber for alternately mechanically locking one of the two magnetic drives, with the mechanical locking device acting on both main slides.

An idea behind at least one embodiment of the invention is for the moveably held mechanical reversing locking device to be arranged directly in the magnetic chamber and for the magnetic chamber to be embodied for receiving both magnetic drives. A magnetic chamber of this type enables the direct locking of a magnetic drive arranged in the magnetic chamber, in particular a main slide of a magnetic drive, while the other magnetic drive is released for operation. If required, the moveably held mechanical reversing locking device blocks the one magnetic drive and then the other. The mechanical reversing locking device is provided directly in the magnetic chamber, which surrounds both the one and also the other magnetic drive.

As a result of the magnetic chamber including both magnetic drives, an electromagnetic low voltage switchgear, in which a magnetic chamber of this type is provided, can be embodied very compactly. The mechanical reversing locking device can act directly on one of the main slides of one of the magnetic drives, by means of a magnetic chamber of this type, said magnetic drive opening and closing the main contacts of the magnetic drive, i.e. blocking this in its movement. The blocking of a magnetic drive functions here such that part of the mechanical reversing locking device engages in a main slide of a magnetic drive and a displacement of the main slide is prevented as a result. Upon engagement of the mechanical reversing locking device into the main slide of one of the magnetic drives, the main slide of the other magnetic drive is released for movement purposes.

The movably held mechanical reversing locking device is arranged in the magnetic chamber. I.e. only one shared magnetic chamber exists for both magnetic drives. To lock the magnetic drives, the mechanical reversing locking device is therefore likewise provided in the one magnetic chamber. Here the mechanical reversing locking device advantageously rests between the two magnetic drives.

A magnetic chamber, in which the mechanical reversing locking device is embodied as a reversing armature held pivotably about an axis, is preferable, with the axis being provided in a wall of the magnetic chamber. The reversing armature, also known as quadrant, can be rotated about the axis, in order thus optionally to block the one or the other magnetic drive. The axis, to which the reversing armature is fastened, is preferably arranged in the wall of the magnetic chamber. The reversing armature herewith rests directly against the magnetic drives, in order to release or block these. By integrating the axis and/or the reversing armature into the wall of the magnetic chamber, the magnetic chamber and thus the electromagnetic low voltage switchgear, in which the magnetic chamber is set, can be compactly integrated.

The magnetic chamber is herewith embodied such that it enables the guidance of the respective main slide and the magnetic drives. I.e. the magnetic chamber comprises at least an intermediate wall in regions, to the two walls of which the two magnetic drives, i.e. the main slide, are guided. The moveably held mechanical reversing locking device, in particular the reversing armature, is arranged on this intermediate wall.

According to a second aspect of at least one embodiment of the invention, an electromagnetic low voltage switchgear is disclosed, in particular by a compact reversing starter, which has two magnetic drives running in opposite directions, with each magnetic drive actuating a main slide, and in which both magnetic drives are arranged in a magnetic chamber embodied according to the first aspect of the invention, with the moveably held mechanical reversing locking device, depending on its position, engaging with a main slide of one of the magnetic drives, in order to fix this.

An electromagnetic low voltage switchgear with a magnetic chamber of this type can be embodied in a very compact and easy fashion. By integrating the moveably held mechanical reversing locking device into the magnetic chamber, a complicated wiring and fastening of the electrical and mechanical locking is avoided. The mechanical reversing locking device also functions advantageously in the case of a power outage. The direct locking of the main slide may result in possible errors in the magnetic drives having no influence on the safety chain. As a result of the mechanical reversing locking device always blocking one of the main slides in its movement, it may not result in both magnetic drives always being able to be operated at the same time.

An electromagnetic low voltage switchgear is particularly preferred, in which each main slide of each magnetic drive comprises a correspondingly designed contour, in particular a groove, a recess or a borehole, for engagement with the mechanical reversing locking device, on its side facing the mechanical reversing locking device. The mechanical reversing locking device engages here in the contour, for instance in the groove, the recess or the drill hole, of a main slide, and thus prevents movement of this main slide. It is particularly advantageous if the mechanical reversing locking device is embodied as a reversing armature and/or quadrant. A reversing armature and/or a quadrant has an approximate T-shaped design. The ends of the T-bar arranged at right angles thereto engage in the correspondingly designed contours of the respective main slide.

The electromagnetic low voltage switchgear preferably comprises a microcontroller for actuating the drive units of the magnetic drives and/or the reversing locking device. I.e. the electrical actuation of the reversing locking device can be realized by the same microcontroller, which is also embodied for actuation of both magnetic drives. The actuation of the reversing locking device takes place in particular by way of the magnetic drives. Hardware can in turn be saved and the electromagnetic low voltage switchgear can be of small dimensions.

Furthermore, an electromagnetic low voltage switchgear is preferred, in which the magnetic drives are embodied as contactor drives. The reversing locking device for mutually blocking the contactor drives prevents the simultaneous closure of the main contacts for changing the direction of rotation of the contactor drives. The technical solution is realized by the reversing armature and/or the quadrant, which blocks the main slide of the respective contactor drives in order to close the contacts. The effect of the reversing armature is directly on the main slides, which open and close the main contacts of the respective contactor drives.

BRIEF DESCRIPTION OF THE DRAWINGS

The invention is now explained with the aid of non-exclusive example embodiments, with reference to the appended drawings, in which.

DETAILED DESCRIPTION OF THE EXAMPLE EMBODIMENTS

Figure 1:
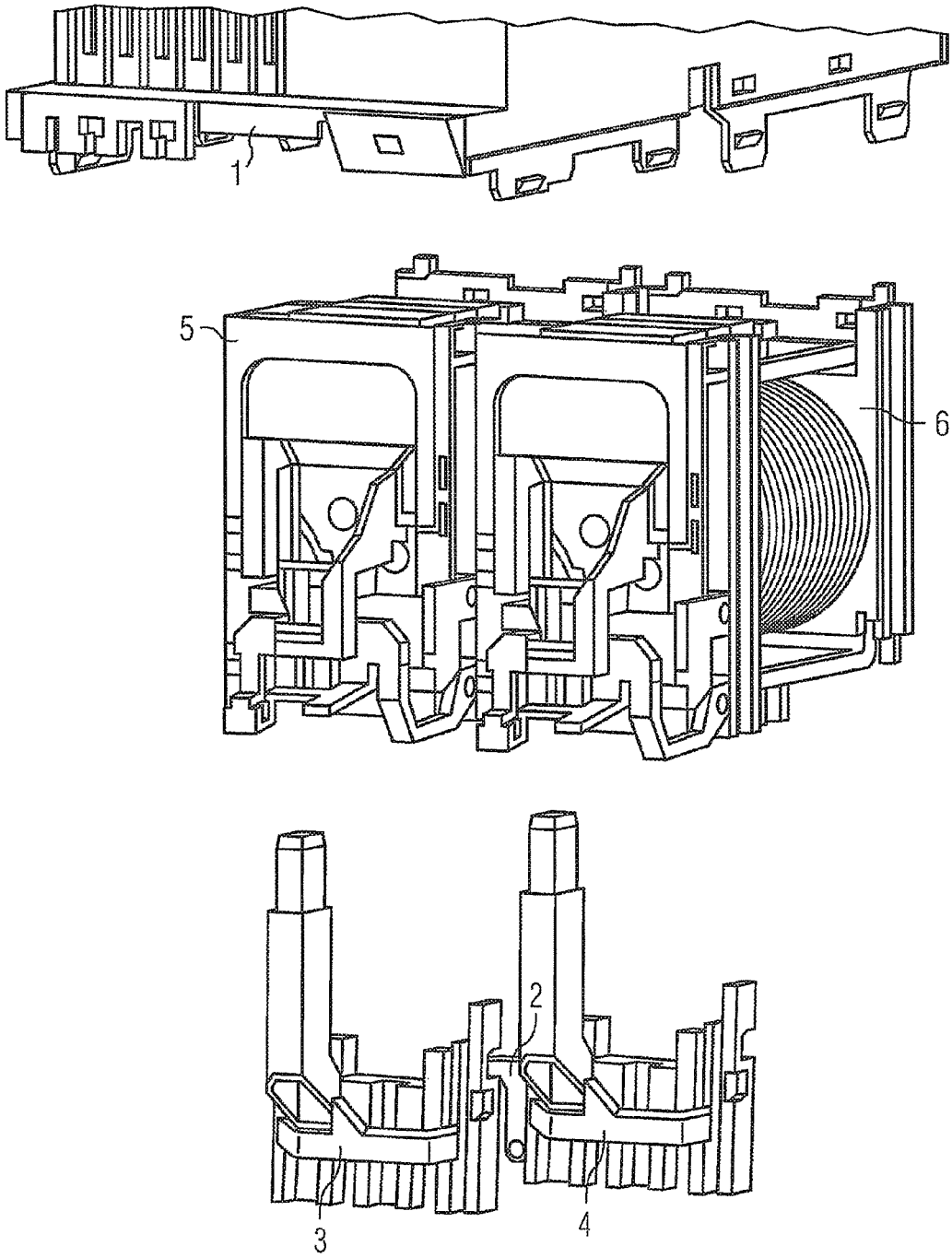
FIG. 1 shows an exploded representation of a magnetic chamber, two magnetic drives and the main slide with the mechanical locking device.

FIG. 1 shows a magnetic chamber 1 and two magnetic drives 5, 6 arranged in the magnetic chamber 1. The magnetic chamber 1 is embodied to receive both magnetic drives 5, 6. The first magnetic drive comprises a first main slide 3, the second main drive 6 comprises a second main slide 4. The two main slides 3, 4 are moveably arranged on the respective magnetic drives.

Figure 2:
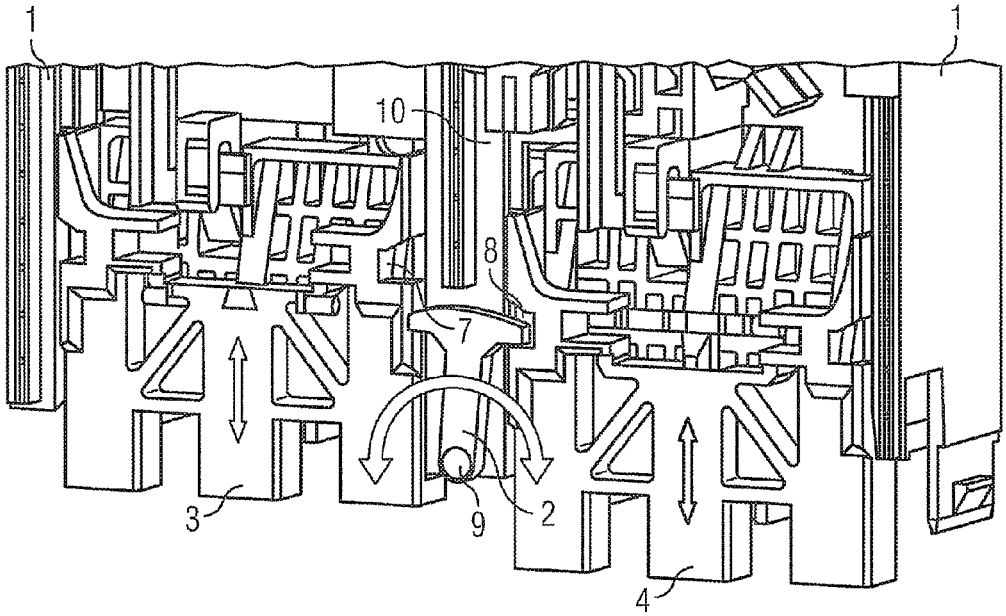
FIG. 2 shows a magnetic chamber, in which two magnetic drives are arranged, and a mechanical reversing locking device provided in the magnetic chamber.

FIG. 2 shows a magnetic chamber 1, in which the two magnetic drives 5, 6 are received. The moveably held mechanical reversing locking device 2, here in the form of a reversing armature, is arranged between the magnetic drives 5, 6 within the magnetic chamber 1. Here the reversing armature 2 optionally engages into a groove and/or recess 7, 8 of the one or other main slide 3, 4 of the magnetic drives 5, 6. In this representation, the reversing armature 2 blocks the main slide 4 of the second magnetic drive 6. The main slide 3 of the other magnetic drive 5 is accordingly not blocked. The reversing armature 2 is moveably mounted about an axis of rotation 9. The axis of rotation 9 proceeds through an intermediate wall 10, which is used both as a guide of the first magnetic drive 5 and/or of the main slide 3 of the first magnetic drive 5 and as a guide of the second magnetic drive 6 and/or of the main slide 4 of the first magnetic drive 6. The arrows on the main slides 3, 4 indicate the direction of movement of the main slides 3, 4.

Figure 3:
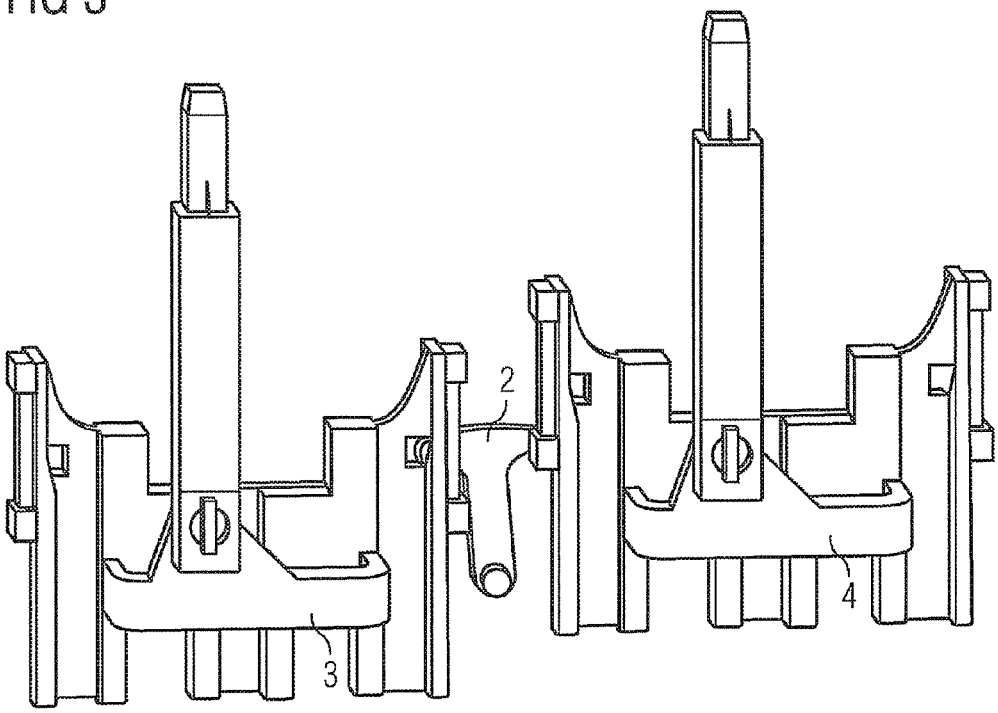
FIG. 3 shows two main slides with a mechanical reversing locking device.

FIG. 3 once again shows the main slides 3, 4 of the two magnetic drives 5, 6. The moveably held mechanical reversing locking device 2, i.e. the reversing armature, rests directly between the main slides 3, 4 and therewith enables a direct blockage of one of the main slides 3, 4 while the other main slide 3, 4 is freely moveable. A locking of this type also functions in the event of a power outage. The direct locking on the main slides 3, 4 results in possible errors in the drives not influencing the safety chain.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A magnetic chamber for an electromagnetic low voltage switchgear including two magnetic drives, each actuatable by a main slide, the magnetic chamber being embodied for receiving the magnetic drives of the electromagnetic low voltage switchgear, that the magnetic chamber comprising:

a mechanical reversing locking device configured to alternately mechanically lock one of the two magnetic drives, arranged in the magnetic chamber, the mechanical locking acting on both main slides such that upon engagement of the mechanical reversing locking device into the main slide of one of the magnetic drives, the main slide of the other magnetic drive is released, and wherein each of the main slides of each of the magnetic drives includes a correspondingly designed contour for engaging the mechanical reversing locking device, the mechanical reversing locking device being configured to selectively engage a recess of the contour, the contour being located on a side of each of the main slides facing the mechanical reversing locking device.

2. The magnetic chamber as claimed in claim 1, wherein the mechanical reversing locking device is a reversing armature that pivots about an axis, whereby the axis is in a wall of the magnetic chamber.

3. The magnetic chamber as claimed in claim 2, wherein the magnetic chamber guides the respective main slides and magnetic drives.

4. The magnetic chamber as claimed in claim 1, wherein the magnetic chamber guides the respective main slides and magnetic drives.

5. The magnetic chamber as claimed in claim 1, wherein the magnetic chamber is for a compact reversing starter.

6. The electromagnetic low voltage switchgear as claimed in claim 1, further comprising a microcontroller configured to actuate at least one of the drive units of the magnetic drives and the reversing locking device.

7. The electromagnetic low voltage switchgear as claimed in claim 1, wherein the magnetic drives are embodied as contactor drives.

8. An electromagnetic low voltage switchgear, comprising:

two magnetic drives, each of the two magnetic drives being configured to actuate a respective main slide, both magnetic drives being arranged in a magnetic chamber, the magnetic chamber including, a mechanical reversing locking device configured to engage with the main slide of one of the two magnetic drives such that upon engagement the main slide of the other magnetic drive is released, and wherein each of the main slides of each of the magnetic drives includes a correspondingly designed contour for engaging the mechanical reversing locking device, the mechanical reversing locking device being configured to selectively engage a recess of the contour, the contour being located on a side of each of the main slides facing the mechanical reversing locking device.

9. The electromagnetic low voltage switchgear as claimed in claim 8, further comprising a microcontroller configured to actuate at least one of the drive units of the magnetic drives and the reversing locking device.

10. The electromagnetic low voltage switchgear as claimed in claim 8, wherein the magnetic drives are contactor drives.

11. The electromagnetic low voltage switchgear as claimed in 4, wherein the electromagnetic low voltage switchgear is a compact reversing starter.

12. The electromagnetic low voltage switchgear as claimed in claim 8, further comprising a microcontroller configured to actuate at least one of the drive units of the magnetic drives and the reversing locking device.

* * * * *